US006578982B1

(12) United States Patent
Lynch

(10) Patent No.: US 6,578,982 B1
(45) Date of Patent: Jun. 17, 2003

(54) STRAP-LIKE APPAREL HAVING LIGHTED STUDS

(76) Inventor: Thomas Paul Lynch, 392 Grafton Ave. No., Oakdale, MN (US) 55128

( * ) Notice: Subject to any disclaimer, the term of this patent is extended or adjusted under 35 U.S.C. 154(b) by 0 days.

(21) Appl. No.: 10/190,026

(22) Filed: Jul. 3, 2002

(51) Int. Cl.[7] ..... F21V 21/08

(52) U.S. Cl. ..... 362/104; 362/103; 362/108; 362/800; 63/1.11; D11/3; D26/38

(58) Field of Search ..... D26/38; D11/3; 362/103, 104, 108, 800; 63/1.11, 1.12

(56) References Cited

U.S. PATENT DOCUMENTS 4,523,258 A * 6/1985 Morse et al. ..... 362/108
4,774,642 A * 9/1988 Janko et al. ..... 362/108
5,567,037 A * 10/1996 Ferber ..... 362/104
5,876,109 A * 3/1999 Scalco ..... 362/104

* cited by examiner

*Primary Examiner*—Stephen Husar
(74) *Attorney, Agent, or Firm*—Thomas B. Tate

(57) ABSTRACT

A strap-like item of wearing apparel which has studs that light up. A light-emitting diode (LED) is disposed within each stud. The LED's are activated by means of a circuit.

1 Claim, 4 Drawing Sheets

STRAP-LIKE APPAREL HAVING LIGHTED STUDS

BACKGROUND OF THE INVENTION

The field of the invention is strap-like apparel (for example, collars, belts) having lighted studs.

Studded belts and collars without lights are well-known in the prior art and are a popular fashion among young people, especially fans of punk or heavy metal music. Lighted belts or collars without studs are also known in the prior art. Some examples are a device made in China and sold at fairs in the United States which has a flex circuit with light-emitting diodes (LED's) and is worn as a belt, bracelet, or collar; a lighted collar with a different type of battery pack which is sold under the trademark Nite-Lite, and a glowing necklace made by Team Products International, Inc., Parsippany, N.J., and sold under the trademark Retro Glo.

However, none of these prior art devices have studs that light up.

SUMMARY OF THE INVENTION

The invention is strap-like apparel having lighted studs. The apparel can be any type of flexible strap, including but not limited to, collars, chokers and necklaces, belts, headbands, bracelets and armbands, and trim strips along the seams of pants. The studs can be any of a number of shapes, including but not limited to, conical, frusto-conical, cylindrical, pyramidal, spherical, diamond-shaped, button-shaped, or nozzle-shaped. The method of lighting studs is by means of light-emitting diodes (LED's) which are positioned within the studs. The circuit which includes the LED's can be any of several types, including but not limited to, a flex circuit or a circuit with batteries and a microprocessor strip.

An advantage of the invention is that it provides a novel fashion item, in that it is now possible to have lighted studded belts, collars, and other strap-like apparel in which the studs themselves light up.

DETAILED DESCRIPTION OF THE INVENTION

Figure 1:
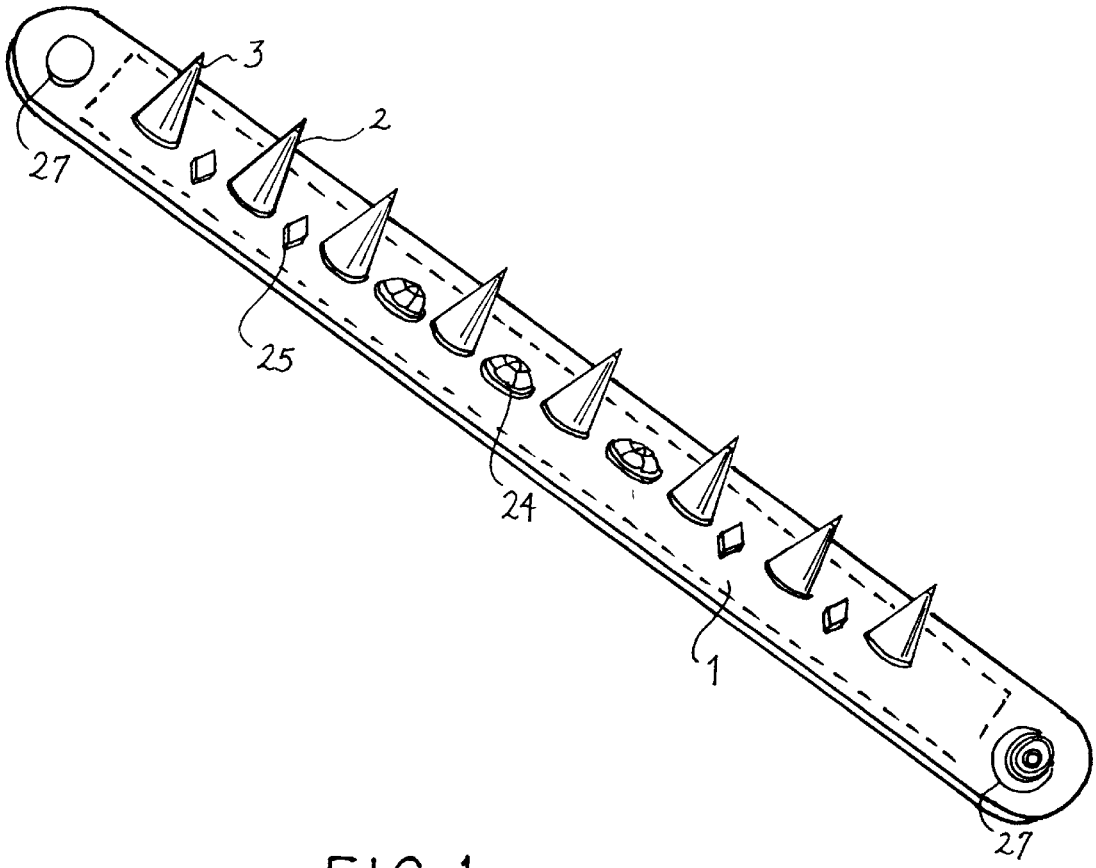
FIG. 1 is a side perspective view of the invention.
Figure 2:
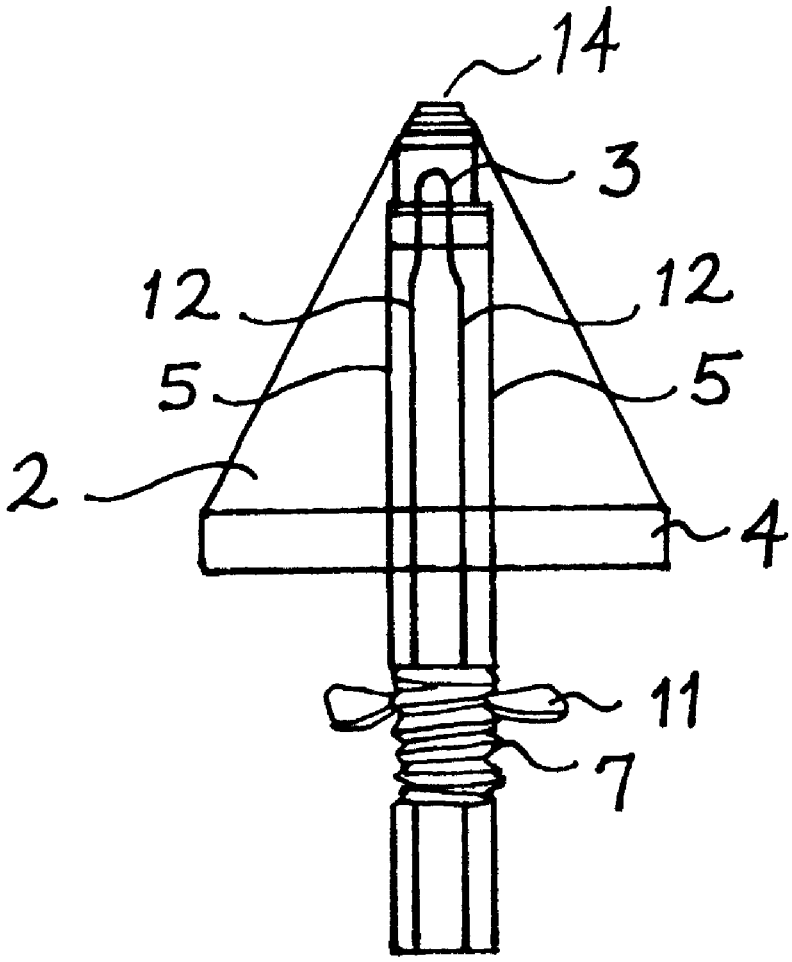
FIG. 2 is a side detail view of a stud and LED, showing a stud which is transparent to reveal the structures within.
Figure 3:
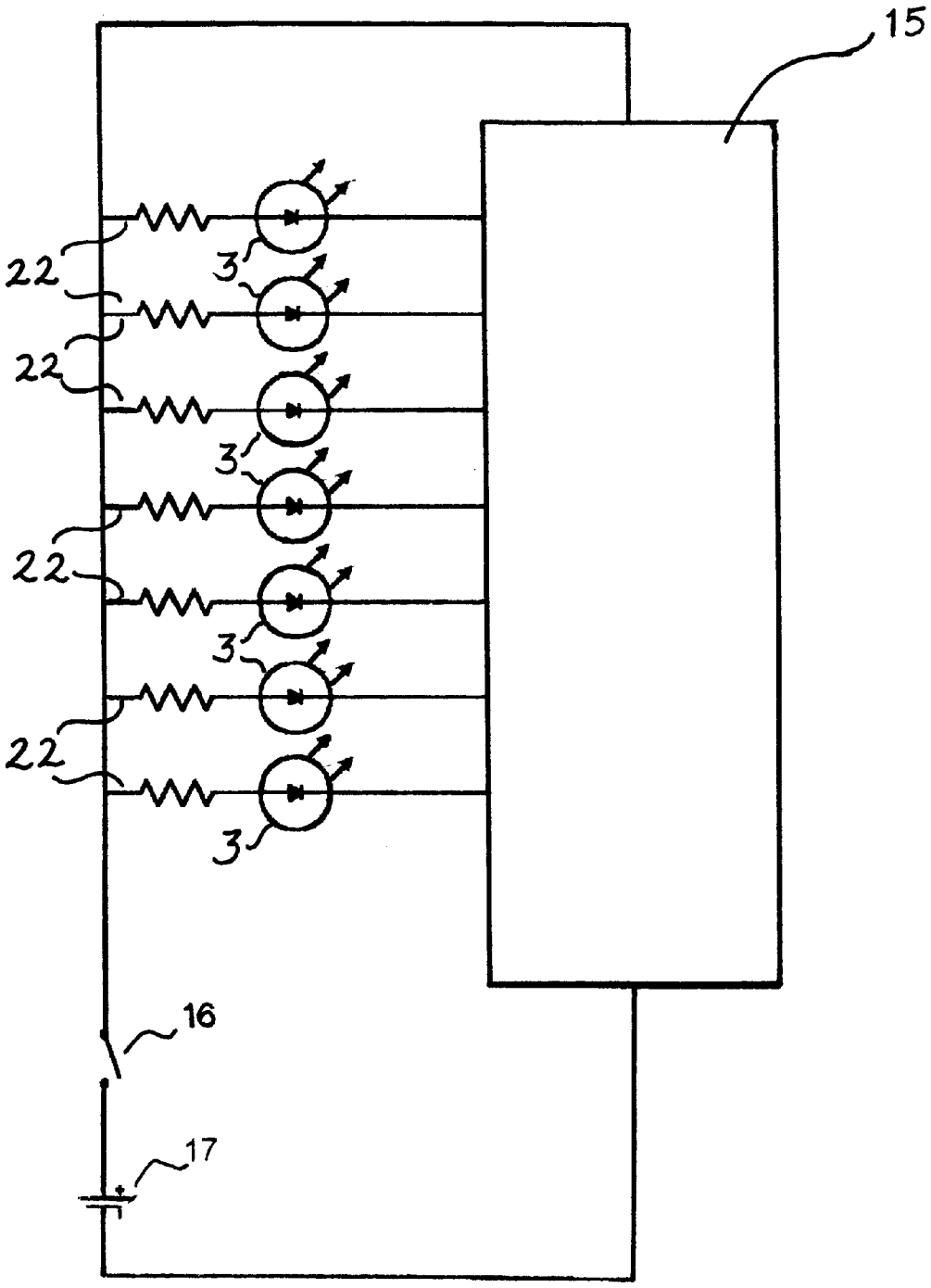
FIG. 3 is a wiring diagram of the circuit.
Figure 4:
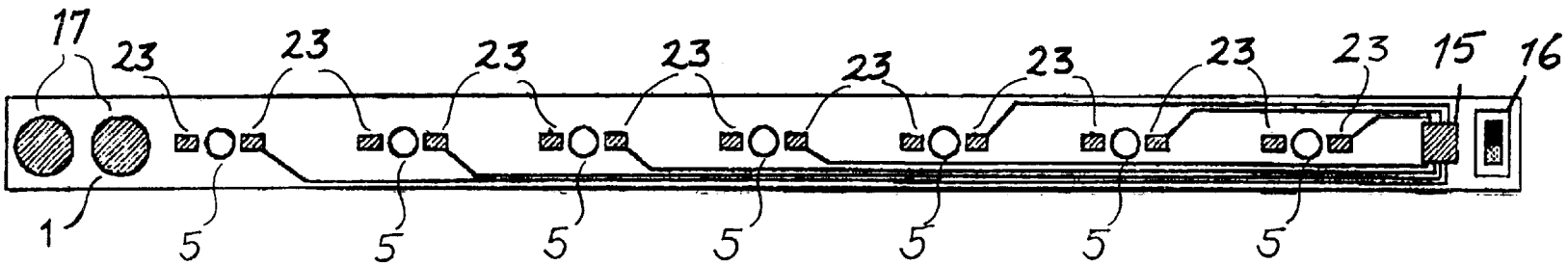
FIG. 4 is a top view of a possible implementation of the flex circuit.

An item of apparel is provided which includes a strap 1, a plurality of studs 2 positioned along strap 1, and a light-emitting diode (LED) 3 disposed within each stud 2.

The strap 1 is an elongated piece of material (preferably leather but other suitable materials can be used) which is flexible enough to be formed into a belt, collar, armband, or other device which encircles some part of the human body. The ends of the strap 1 can be fastened together by any suitable means, for example, by snaps 27 or by the hook and loop fasteners known by the trademark Velcro. It is also possible to wear the strap 1 as a straight piece which is sewn onto or otherwise attached to an article of clothing.

A plurality of studs 2 are disposed within openings in the strap 1. The studs 2 will usually be aligned in a straight row, but other configurations can be used. The studs 2 are preferably made of metal, but other materials such as plastic (which could be transparent) can be used. The studs 2 can be of any shape which is capable of containing an LED 3. Common shapes will include a conical stud which has its tip cut off, or a stud which is more or less nozzle-shaped (shaped somewhat like the bishop in a chess set), but the range of lighted items, in addition to other shapes of studs 2, could also include rhinestones 24 or diamond-shaped spots 25. Each stud 2 has a shoulder 4 formed as an integral part of the stud 2 at the bottom end thereof. An opening 5 is formed through each stud 2 from top to bottom in order to form a channel through which the LED 3 can pass. Each stud 2 has threads 7 at its base. A nut 11 fits over the threads 7 to hold the stud 2 in position; thus no indentations in the strap 1 are needed.

An LED 3 is positioned within each stud 2. The LED 3 has two electrical leads 12 which are soldered together at the top and which extend through the channel 5 of the stud 2, and are held in position by threads 7 and nut 11. The light 14, which is the part of the LED 3 that lights up, is a generally dome-shaped piece that fits over the LED leads 12 in the opening 5 at the top of the stud 2. Most commonly the LED 3 will be a three millimeter (outside diameter) LED, but other sizes such as five millimeter LED's can be used.

A low power flex circuit activates the LED's 3. The function of the circuit is to drive a number of LED's in a pattern that is selected by either the vendor or the customer. The pattern has a large number of variations including: (a.) The sequence in which the LED's are lit. A sequence could be random or left-to-right or right-to-left, but there exists n! (n factorial) variations, where n is the number of LED's in the circuit; (b.) The time for which the LED's are illuminated, or duty cycle; (c.) The time in between when the LED's are illuminated, or period. The period may or may not be constant during the pattern; and (d.) The number of LED's that are simultaneously lit. Several patterns can be chained together also. One or more patterns are repeated indefinitely while power is applied to the circuit. The circuit is low power to minimize the size of the batteries, since the strap is designed to be portable. Also, the strap requires a circuit that is flexible so it can be bent around the wearer.

The circuit includes a small micro-controller integrated circuit (IC) 15, a switch 16, one or more batteries 17, a plurality of LED's 3, and current limiting resistors 22. The micro-controller 15 has a dedicated output pin for each LED 3, so that it has total control over the pattern. A current limiting resistor 22 is associated with each LED 3, and limits the power consumption and protects from over-driving the LED 3. The number of LED's 3 depends upon the size of the strap 1 and the amount of space between LED's 3. A switch 16 controls the circuit power. A battery or series of batteries 17 provides the power to the circuit. Preferably between one and four batteries 17 will be used. The entire electronic circuit is constructed on a flex circuit to provide the flexible movement required by the strap 1.

There are several micro-controllers 15 that could be used in this application. One such example is the Microchip PIC 16C56, which has an on-chip Read Only Memory (ROM) for program storage as well as on-chip Random Access Memory (RAM) that is used for state information relating to the program.

A "C" or assembly level program is written that drives the output pins and lights the corresponding LED's 3. The program is modified to display a pattern or series of patterns that have been specified. The program is then downloaded into the micro-controller 15. When the circuit is turned on, the program is executed and the LED's 3 flash in the pattern determined by the program.

The low power requirement is met by a couple of different methods. First, the duty cycle of the LED's 3 is kept as short as possible, since the LED's draw virtually no power when they are off. Second, the clock frequency of the micro-controller 15 is kept as small as possible to minimize its power consumption. Different patterns will probably have different rates of power consumption.

The flex material on the strap 1 holds the assembly together mechanically and provides a means of routing the conductors from the LED's 3 to the micro-controller 15. The batteries 17, which are low profile so that they can fit the form factor of the strap 1, are connected to the conductors (not shown). The pads 23 are used to attach the conductors within the flex to the electrical leads 12 of the LED's 3 which come through the openings 5 that are immediately under the LED's 3. The micro-controller 15 drives each of the LED's 3. The switch 16 is used to turn the power to the circuit on and off.

I claim:

1. Strap-like apparel having lighted projections, said apparel comprising:

a flexible strap;

a plurality of projections positioned along said strap;

a plurality of light-emitting diodes (LED's), each of said LED's being disposed within one of said projections such that the light produced by each of said LED's is visible through an opening formed into the top end of its respective projection;

and circuit means for activating said LED's;

wherein said lighted projections include both studs and rhinestones.

* * * * *